United States Patent [19]

Munz

[11] Patent Number: 5,036,953

[45] Date of Patent: Aug. 6, 1991

[54] RETRACTABLE ELEVATOR DOOR

[76] Inventor: William E. Munz, 496 Ixworth Crt., Serverna Park, Md. 21146

[21] Appl. No.: 420,536

[22] Filed: Oct. 12, 1989

[51] Int. Cl.[5] ..... B66B 13/00

[52] U.S. Cl. ..... 187/56; 160/196.1

[58] Field of Search ..... 187/57, 56, 52, 51, 187/58, 1 R; 160/196.1, 201, 199

[56] References Cited

U.S. PATENT DOCUMENTS

| | | | |
|---|---|---|---|
| 1,180,156 | 4/1916 | Kranebiel | 187/52 R |
| 1,654,857 | 1/1928 | Brady | 160/196.1 |
| 1,735,153 | 11/1929 | Bouton | 187/52 R |
| 2,689,003 | 9/1954 | Helbert et al. | 160/196.1 |
| 3,003,551 | 10/1961 | Ferris | 160/196.1 |

FOREIGN PATENT DOCUMENTS

| | | | |
|---|---|---|---|
| 1183386 | 9/1957 | France | 160/196.1 |

*Primary Examiner*—Robert P. Olszewski
*Assistant Examiner*—Kenneth Noland
*Attorney, Agent, or Firm*—Leonard Bloom

[57] ABSTRACT

A manually operated door for an elevator cab opening includes a top track, a bottom track, and a plurality of door panel assemblies supported by the top track. Each of the tracks includes a front portion parallel to the cab opening, a curved portion adjacent the front portion and undergoing a right angle bend, and a side portion adjacent the right angle bend, parallel to a side wall of the cab. The top track includes inner and outer parallel and concentric track portions. A three wheeled carriage is provided for riding in the top track, whereby the door panels can readily make tight radius turns in being moved from open to closed and vice versa. Door assemblies are guided by the top and bottom tracks. An individual door assembly includes the three-wheeled carriage, a hinge pin supported by the carriage and extending down to the bottom track and guided thereby, and a tangential roller supported by the hinge pin. The tangential roller engages a complementary guide portion in the top track, whereby movement of the door assemblies through the curved track portion is facilitated. Horizontal support bars and right angle brackets are used to pivotally connect the door panels to the hinge pins. When the door assembly is moved through the right angle bends, the carriage, the hinge pin, the tangential roller, the horizontal support bars, and the right angle brackets turn on the same vertical axis defined by the longitudinal axis of the hinge pin.

35 Claims, 7 Drawing Sheets

RETRACTABLE ELEVATOR DOOR

FIELD OF THE INVENTION

The present invention relates to the field of elevators, and especially to manually operated doors for small elevators.

Background of the Invention

In commercial buildings, doors for opening and closing the entrance and exit opening through which passengers enter and exit the elevator are generally comprised of two sets of large solid door panels that are moved from the open to the closed position and back, on colinear tracks, by one electric motor. One set of door panels is for the elevator cab, and the other set of door panels is for the hoistway. The door panels are moved toward each other to close the opening and away from each other to open the opening.

When the large solid door panels are moved away from each other to open the opening, the door panels are often moved into receiving areas, outside the elevator cab, that are large enough to accommodate the panels. Since the door panels are relatively large, the receiving areas outside the elevator cab for the door panels must also be relatively large. In large commercial buildings, there may be no problem in providing the space needed outside the elevator cab for receiving the door panels. Also, in a large commercial building there may be no problem in providing the additional space needed outside the elevator cab for housing an electric motor and accompanying power transmission devices such as cables and pulleys.

However, when an elevator is used in a relatively small structure, such as in a private home or small apartment building, it may not be possible to provide enough space outside the elevator cab for receiving relatively large elevator door panels when the cab opening is open; and it may not be possible to provide enough space outside the elevator cab for housing an electric motor and associated cables and pulleys for opening and closing the door panels. A private home or small apartment building may simply not have enough space outside the elevator cab to alot for relatively large elevator door panels. It would be desirable, therefore, to provide an elevator door that does not require alot of space outside the elevator cab for receipt of door panels when the cab and hoistway opening is open.

Devices are disclosed in the prior art in which an elevator gate is retained inside the elevator cab in both the open and closed positions. More specifically, U.S. Pat. No. 2,025,566 of Bogart discloses an elevator gate that takes a 90 degree turn on vertically oriented rollers and a track inside an elevator cab. Also, U.S. Pat. No. 2,100,882 of Tamsitt discloses an elevator gate taking a 90 degree turn on vertically oriented rollers and a track inside the elevator cab.

Unfortunately, use of the elevator gates of Bogart and Tamsitt would pose a problem if they were to be used in an elevator cab that is relatively small, such as present in an elevator installed in a private home. When the elevator gates described in the prior art patents are moved through the 90 degree bend, the gate itself makes a considerable movement interior of the cab. More specifically, each end of the elevator gate is supported by a complement of wheels. During the movement of the gate from the open position to the closed position, or vice versa, after one set of wheels passes through the 90 degree bend in the track, but before the other set of wheels passes through the 90 degree bend, the elevator gate moves away from the 90 degree bend and becomes, in essence, the hypotenuse of a right triangle with the other sides of the triangle being defined by the front and side portions of the track adjacent the 90 degree bend. By moving out into the interior of the elevator cab, the elevator gate undesirably takes up precious elevator cab space. It would be desirable, therefore, if the gate for the interior of an elevator be movable from the open to the closed position without taking up much of the interior cab space in doing so.

Some small elevators used in private homes or small apartment buildings employ manually operated, collapsible type gates. One disadvantage with such gates is that they have many open areas between the solid elements forming the gate. The open areas may pose a problem in that they permit an elevator passenger to accidentally put a limb, such as a finger, hand, or foot, through an opening and expose that limb to possible extreme danger. If a limb protrudes through such an opening when the elevator is in operation, the limb can be crushed between the moving elevator cab and the stationary hoistway wall adjacent to the elevator cab. If would be desirable, therefore, if a manually operated elevator door were provided that would avoid the use of open spaces in the door and would prevent a limb from being caught between a moving elevator cab and stationary building structures.

Generally, solid elevator doors are comprised of opaque materials. As such, when a passenger is in the elevator cab and the door is closed, the passenger is unable to see outside the cab. Conversely, when the elevator door is closed, no one outside the elevator cab can look inside the cab. For a number of reasons, it would be desirable for the door of an elevator to have at least some transparent portions to permit passengers in the cab to see outside the cab and to permit persons outside the cab to see into the cab. For example, security of passengers would be greatly enhanced if persons outside the cab could see inside while the doors were closed.

Other known prior art patents that relate to movable doors suspended on tracks are as follows:

| U.S. Pat. No. | Inventor |
|---|---|
| 1,155,390 | Willard |
| 1,188,482 | Phillips |
| 1,259,042 | Phillips |
| 2,047,855 | Cornish |
| 3,071,825 | Ferris |
| 4,457,046 | Vater |

SUMMARY OF THE INVENTION

Accordingly, it is an object of the present invention to provide an elevator door that does not require alot of space outside the elevator cab for receipt of door panels when the cab opening is open.

Another object of the invention is to provide an elevator door that, in the open position, allows the greatest possible open space to walk through in relation to cab width.

Still another object of the invention is to provide a door for the interior of an elevator that is movable from the open to the closed position without taking up much of the interior cab space in doing so.

Another object of the invention is to provide an elevator door that does not have large open spaces in the door thereby preventing a limb of an elevator passenger from being caught between a moving elevator cab and stationary building structures.

In accordance with the teachings of the present invention, a retractable elevator door is provided. The elevator door, especially an elevator cab door, includes a plurality of relatively narrow door panels that are connected to and that are supported by, hinge structures located between the sides of adjacent door panels. The hinge structures of the invention are supported from above by a carriage which rides in a top track which includes a 90 degree bend. When the cab door is in one position, the closed position, the cab opening is closed so that the elevator can safely move from one floor to another. When the door is in a second position, the retracted or open position, the cab opening is open and passengers can enter and exit the elevator cab.

More specifically, the track supporting the door has a front portion, the 90 degree bend, and a side portion. When the cab opening is closed, the plurality of relatively narrow door panels are hanging from the carriages located in the front portion of the track. As the elevator door is being retracted, that is as the cab opening is being opened, the plurality of door panels are moved through the 90 degree bend and are moved to the side portion of the track. When the cab opening is fully open, the plurality of door panels are located in the side portion of the track.

The door panels are supported by a plurality of door panel support assemblies which are characterized in including a carriage for top rollers which move in the top track, a hinge pin supported by the carriage and extending down from the carriage and supporting adjacent door panels, and a bottom guide roller which moves in a bottom track. A door panel support assembly and an associated door panel may be thought of, in combination, as a door panel assembly. With the elevator door of the invention, when a door panel support assembly and an associated door panel (a door panel assembly) moves through the 90 bend portions of the top and bottom tracks, respectively, the turning parts associated with one side of the given door panel assembly turn on the same vertical axis at the same time. That is, the carriage, the hinge pin, and the bottom guide roller, along with the adjacent door panels attached to the hinge pin, turn at the same time on the same vertical axis defined by the longitudinal axis of the hinge pin.

The track for the door panels may be located entirely within the interior of the elevator cab. With the track being located within the elevator cab, the retractable door of the invention does not require space outside the cab to house the cab door.

Moreover, since the retractable elevator door of the invention includes a plurality of door panels, in contrast with a single solid elevator door as disclosed in the prior art, the amount of space that the door panels of the invention occupy in the interior of the elevator cab, when they move through the 90 degree bend, is substantially reduced to the point of being negligible.

By employing the principles of the invention, numerous objects are realized and numerous benefits are obtained. For example, an elevator door is provided that does not require alot of space outside the elevator cab for receipt of door panels when the cab opening is open. With the invention, an elevator cab door is provided that does not require an electric motor and associated cables and pulleys for opening and closing the cab opening. The invention provides a gate for the interior of an elevator that is movable from the open to the closed position without taking up much of the interior cabin space in doing so, and allows for the maximum clear open area in relation to cab width. The invention provides an elevator door that avoids the use of open spaces in a closed door and prevents a passenger's limb from being caught between a moving elevator cab and stationary building structures. With the invention, elevator doors are provided in which at least a transparent door portion permits passengers inside the elevator cab to see outside the cab and permits persons outside the cab to see inside the cab when the door is closed.

In accordance with another aspect of the invention for an elevator cab having an access opening and at least one side wall portion, a combination is provided which includes a retractable door assembly having a closed position covering the access opening and further having a retracted position substantially adjacent to the side wall of the elevator cab. The door assembly is segmented and includes a plurality of panels pivoted with respect to each other by hinge pins. A trackway for supporting the door assembly includes upper and lower guide tracks, respectively. Each guide track includes a curved portion substantially between the access opening and the side wall portion of the elevator cab. A carriage is connected to each door panel for supporting the weight thereof. Each carriage includes at least one first guide roller (preferably a set of wheels) journaled substantially on a horizontal axis and riding in the upper guide track. Each carriage further includes a second guide roller journaled substantially on a vertical axis (hinge pin) and riding in the lower guide track. The first guide roller has a lateral clearance with respect to at least the curved portion of the guide track, so that any lateral thrust loads are taken up by the second guide roller (a tangential roller) as the segmented door is retracted into its open position and extended into its closed position with respect to the elevator cab, respectively. Thereby a free and easy movement is assured and jamming problems are eliminated as the segmented door is guided by the lower guide track. The tangential roller, in guiding the door panels, prevents the carriage wheels from rubbing up against side walls adjacent the guide tracks. Thereby, carriage wheels roll freely as the door panels move through the respective right angle bends.

These and other objects and advantages of the present invention will become apparent from a reading of the following specification, taken in conjunction with the enclosed drawings.

DESCRIPTION OF THE PREFERRED EMBODIMENT

Figure 1:
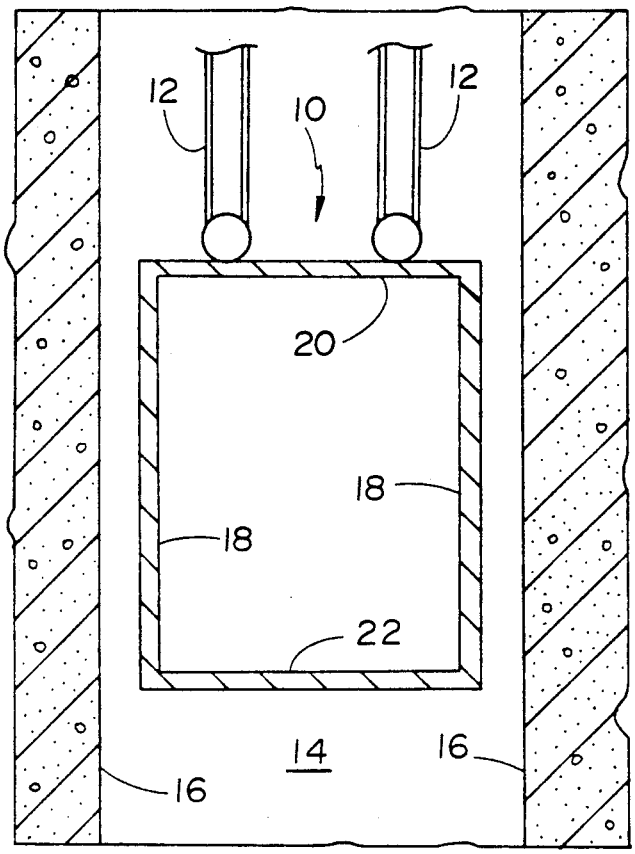
FIG. 1 is a schematic drawing of an elevator cab in a hoistway, there being a clearance or space between the wall of the cab and the hoistway wall.

With reference to the drawings, and more particularly to FIG. 1, an elevator cab 10 is shown suspended by cables 12 within a hoistway 14 having walls 16. The cab includes cab walls 18, ceiling 20, and floor 22.

Figure 3:
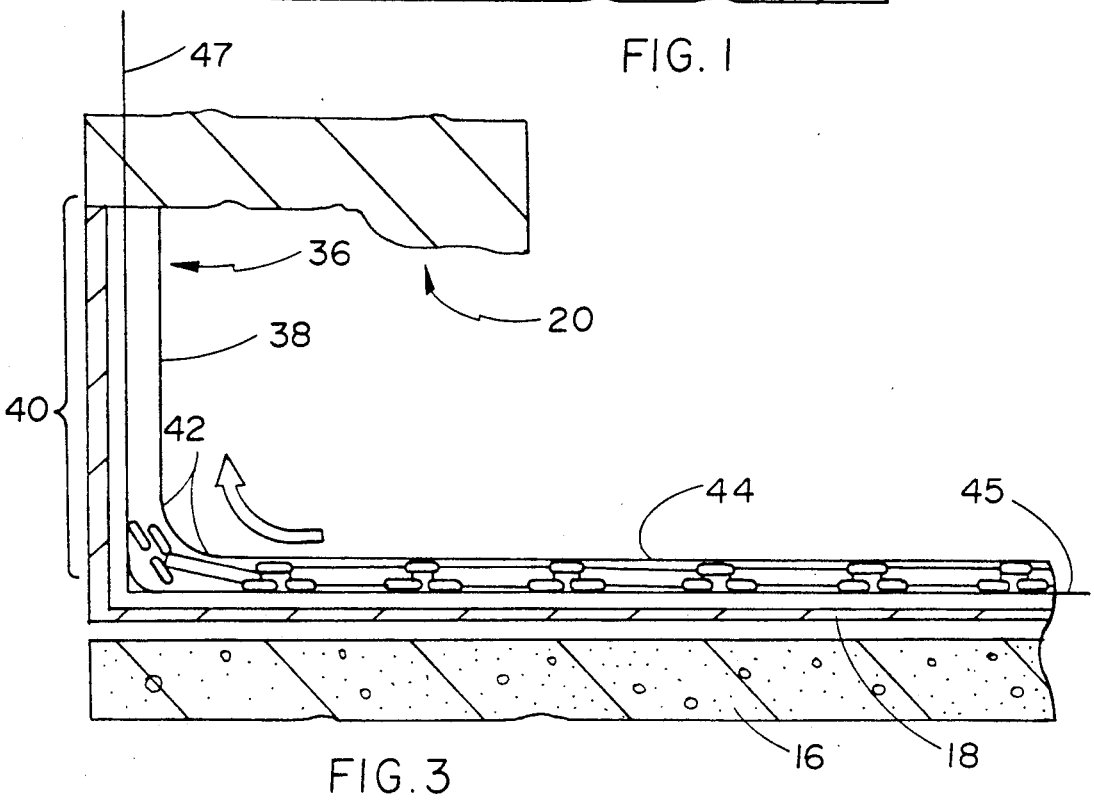
FIG. 3 is a top view of the retractable door of the invention shown in FIG. 2.
Figure 2:
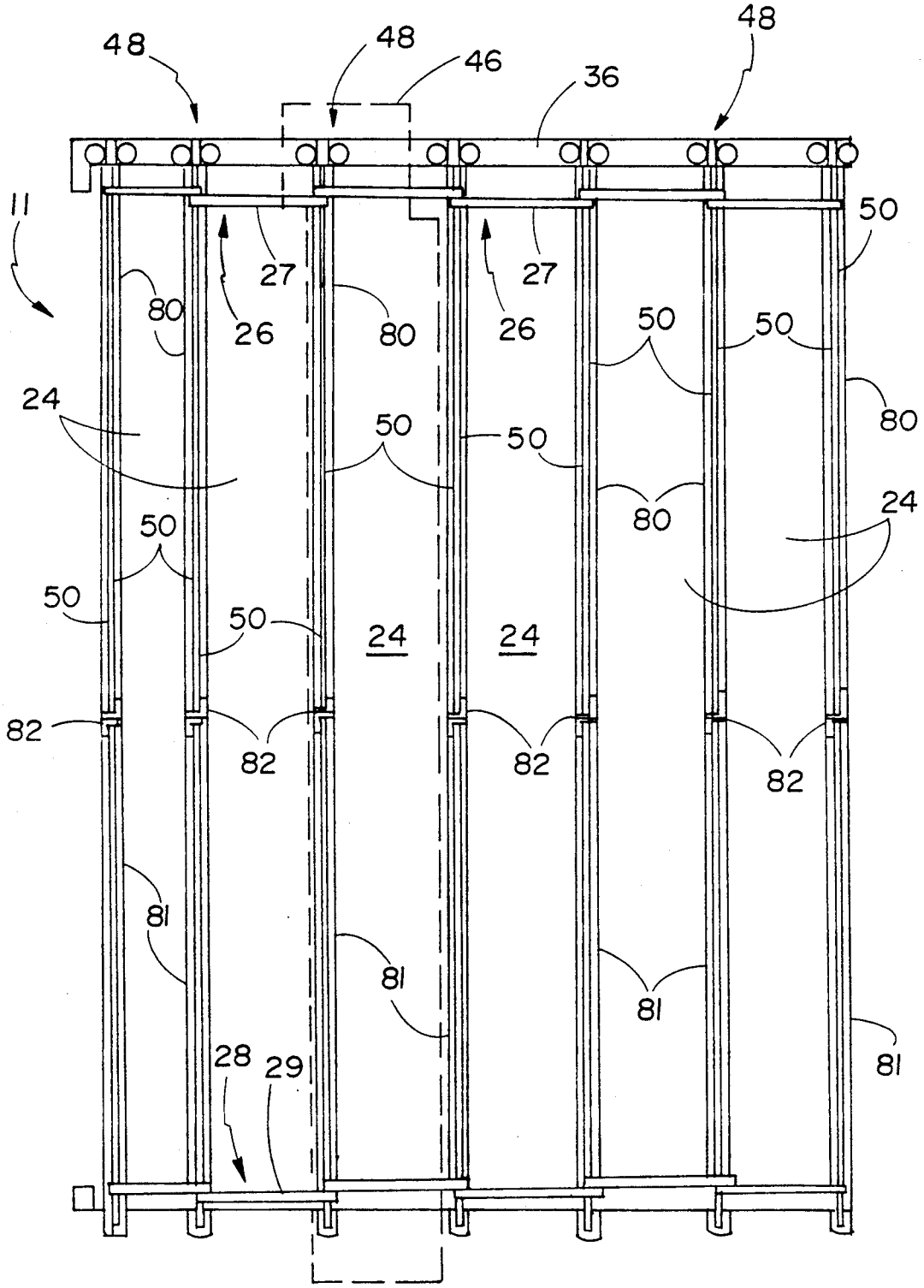
FIG. 2 is a side view of a retractable door of the invention installed inside an elevator cab wherein the door is in the open position with the door panels to the side of the cab opening (See FIG. 3).
Figure 7:
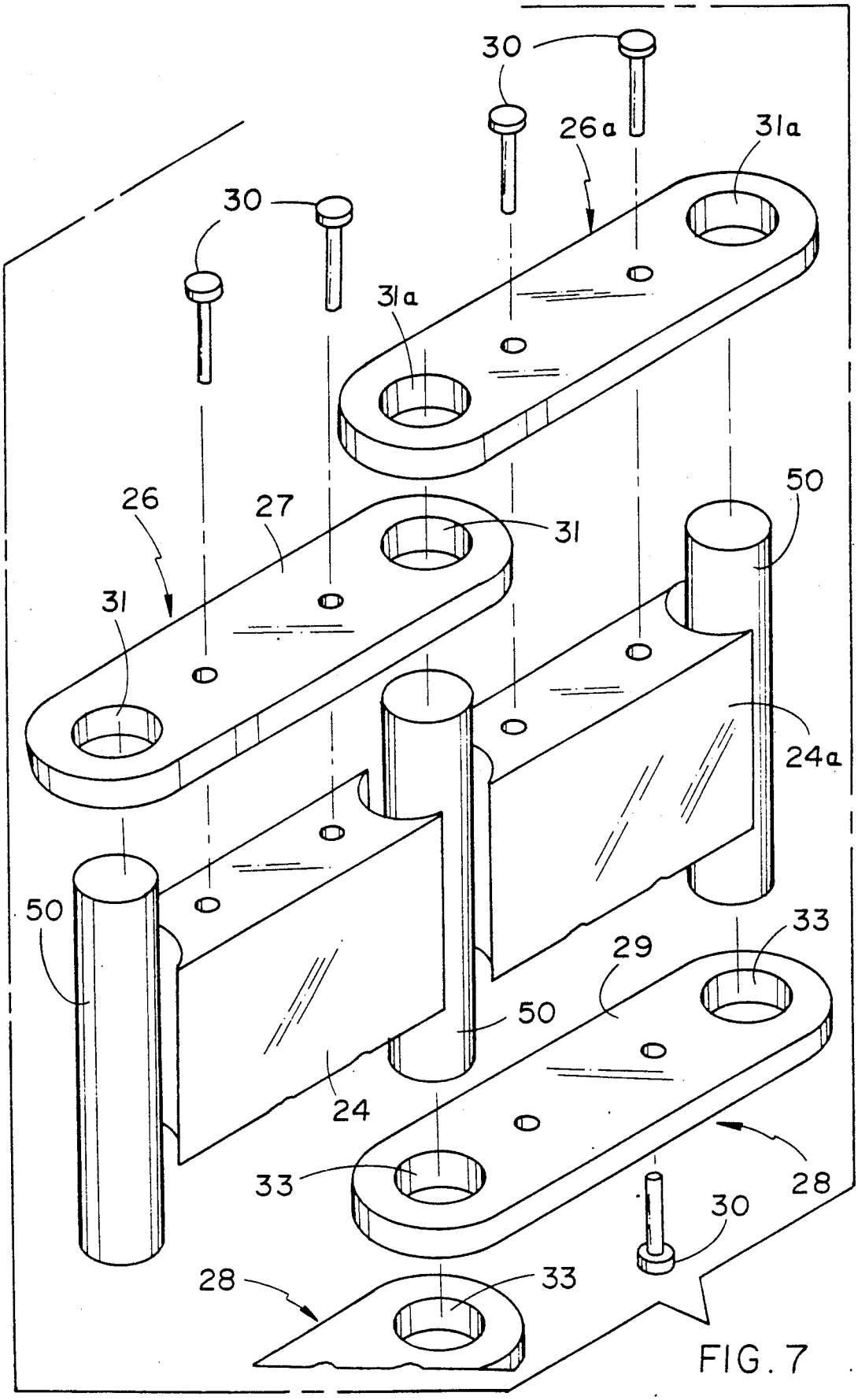
FIG. 7 is an exploded view of the horizontal bar arrangement for supporting adjacent door panels.

In FIG. 2, a retractable elevator cab door 11 is shown wherein the door 11 is in the open (or retracted) position (also see FIG. 3). The door 11 is segmented and includes a plurality of door panels 24 pivoted with respect to one another. The door panels 24 are supported by upper horizontal support bars 26 and lower horizontal support bars 28. The support bars 26 and 28 have mid-portions 27 and 29, respectively, which are directly attached to the panels 24 such as by screws 30 (shown in FIG. 7). The horizontal support bars 26 and 28 have end portions which include orifices 31 and 33, respectively, (shown in FIG. 7). Also, as shown in FIG. 7, adjacent horizontal support bars 26 and 26*a* of adjacent door panels 24 and 24*a*, respectively, overlap one another when their orifices 31 and 31*a* are about to be placed in pivotal connection with hinge pin 50.

As shown in FIG. 3, a top track 36, supported by the cab ceiling 20, includes a front portion 38 which is substantially parallel to cab opening 40 (or access opening) and is adjacent thereto. A curved track portion 42 is contiguous with the front portion 38 and undergoes a substantially right angle (90 degrees) bend. A side track portion 44 is contiguous to the right angle bend portion 42 and is substantially parallel to a side wall 18 of the cab 10 and is adjacent thereto. The front and side track portions may be fabricated from wood or plastic. The curved track portion 42 is preferably fabricated from plastic.

The door 11 of the invention includes a plurality of door panel assemblies 46 (one of which is shown in the dashed box shown in FIG. 2). The door panel assemblies 46 (or more simply, door assemblies) are supported by and guided by the top track 36 and are capable of being moved along the track 36, whereby they serve to open the cab opening 40 when they are located in the side track portion 44 away from the cab opening 40 as shown in FIG. 3; and whereby they close the cab opening 40 when they are located parallel to the cab opening 40 in front track portion 38.

Further referring to FIG. 3, line 45 represents a line drawn along side the outer edge of the door panels 24 in the open (or retracted) position and is parallel to the side track portion 44 which is parallel to the side wall 18. In other words, the door panels 24 are bounded by line 45. Line 45 extends to intersect another line 47 at a right angle. Line 47 represents a line drawn parallel to the front wall track portion 38 which is parallel to cab opening 40 and would be along side the outer edge of door panels 24 when the door is in the closed position. Similarly, door panels 24 would be bounded by line 47. An important feature of the present invention is that as the door is moved from the open to the closed position, and vice versa, the door panels 24 do not cross over the bounding lines 45 and 47. This feature provides the additional benefit of permitting the track 36 and panels 24 to be located close to the interior cab wall 18 without having the panels 24 hit the wall 18 as they move through the right angle bend portion 42. Furthermore, by placing the door very near the interior cab wall 16, but not rubbing the wall 16, more space is available for passengers inside the elevator.

As shown in FIG. 2, each of a plurality of the door assemblies 46 includes a carriage 48 which is supported by the top track 36 and is guided thereby. A straight hinge pin 50 is supported by the carriage 48 and extends down toward the bottom or floor 22 of the elevator cab 10. Movement of the hinge pin 50 when the door 11 is opened or closed is guided by the top track 36.

Figure 4:
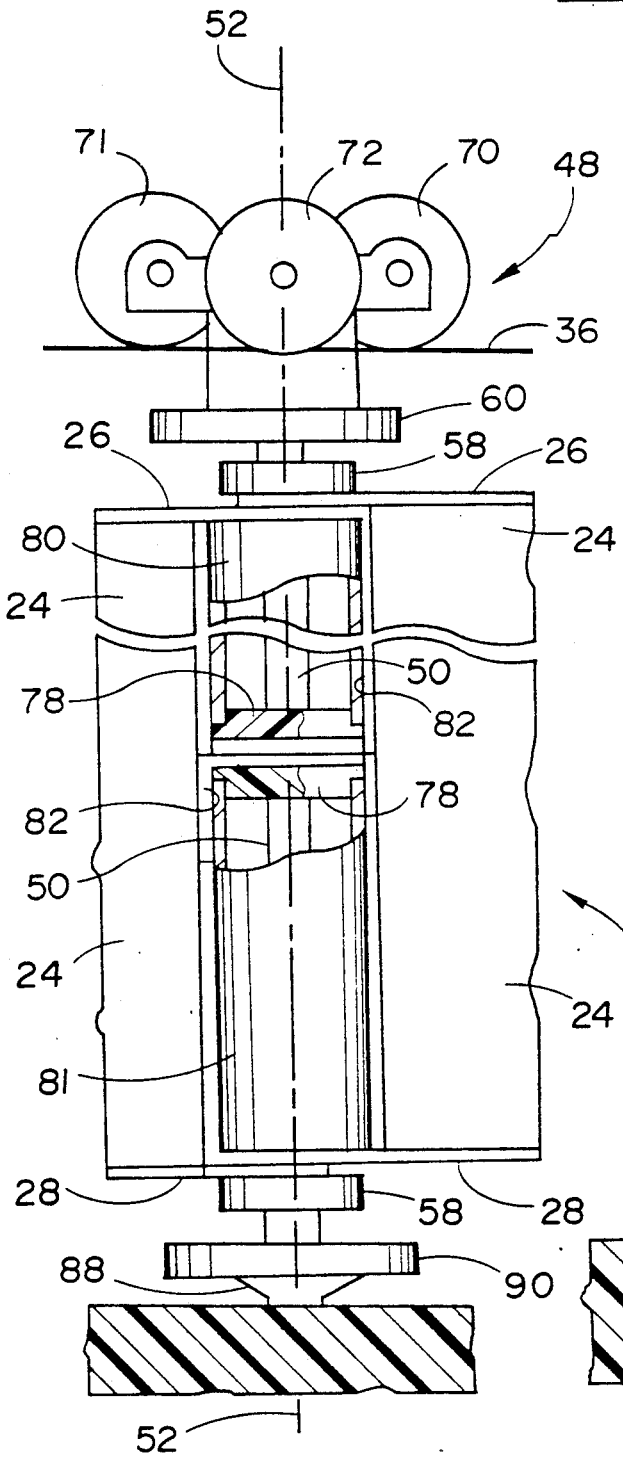
FIG. 4 is an enlarged side view of a hinge pin in the embodiment in FIG. 2 and the assemblies which are aligned by the hinge pin.
Figure 8:
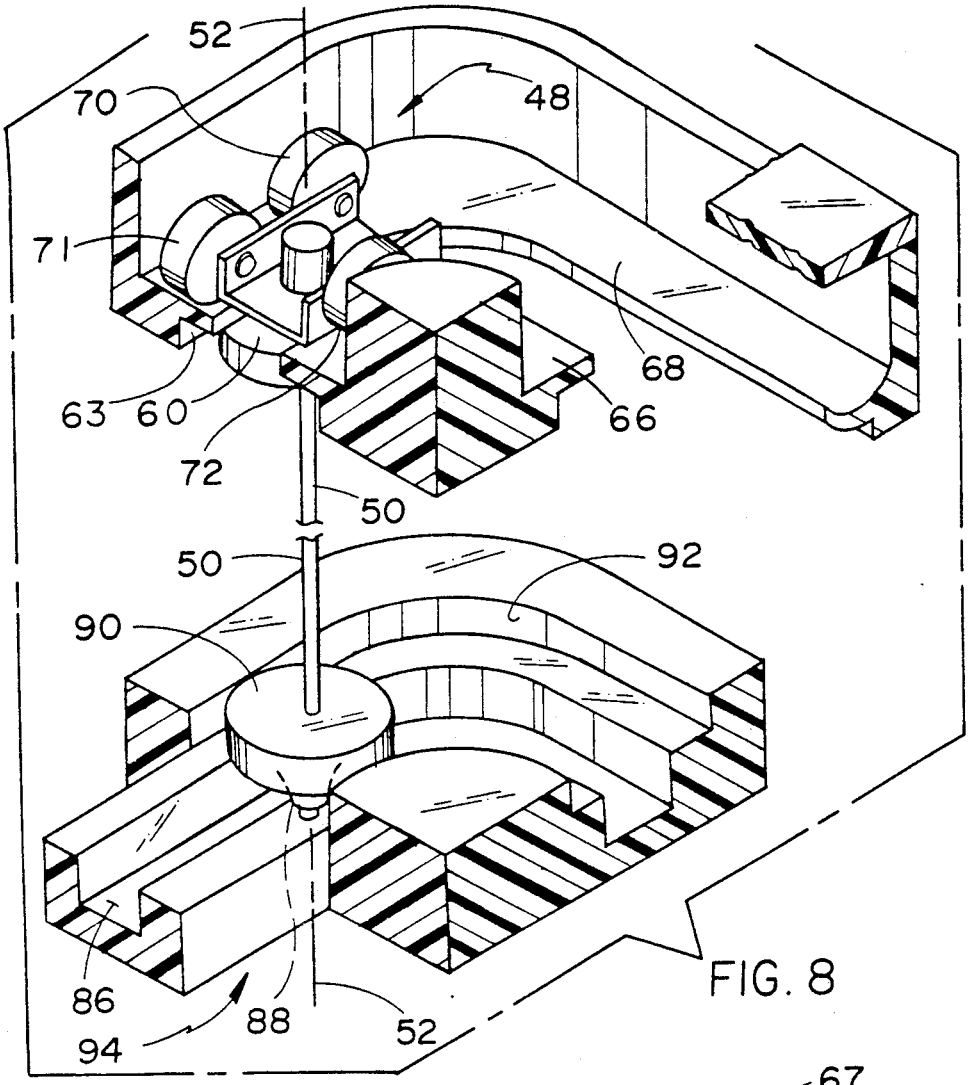
FIG. 8 is another schematic view showing the alignment of the components of a door assembly of the invention.

As shown in FIGS. 4 and 8, the carriage 48, the hinge pin 50, and the horizontal support bars 26 and 28 turn on the same vertical axis 52 defined by the longitudinal axis of the hinge pin 50 when a door assembly is moved through the right angle bend 42 of the top track 36. The hinge pin 50 includes a top end 54 and a bottom end 56. The horizontal support bar 28 (in FIG. 4) is located at the bottom end of the panel 24 near the bottom end 56 of the hinge pin 50. A lock nut 58 (in FIG. 4) is located near the bottom end 56 of the hinge pin 50 and supported thereby. The lock nut 58 may be supported by the hinge pin 50 by means of screw threads. The lock nut 58 supports the weight of adjacent door panels 24 by supporting the bottommost panel supports 28 of adjacent panels.

Figure 6:
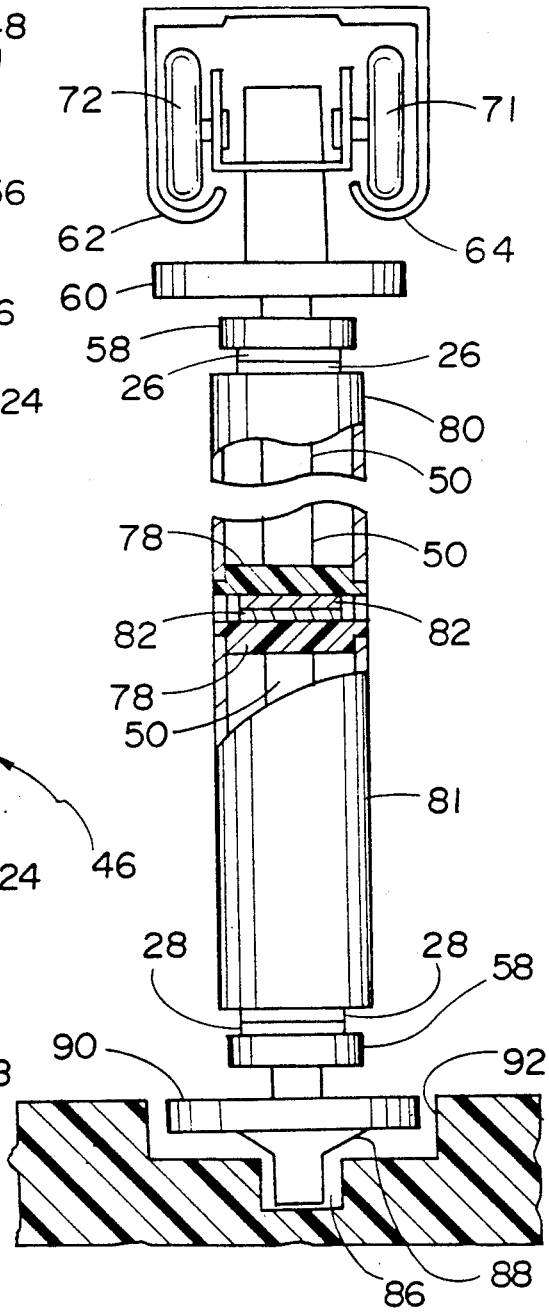
FIG. 6 is a cross-sectional view, perpendicular to the view shown in FIG. 4, of a hinge pin and associated assemblies shown in FIG. 4, with a track supporting the three-wheeled carriage and a hollow tube enclosing the hinge pin.

As shown in FIGS. 4, 6 and 8, a tangential roller 60 is supported by and journaled on the hinge pin 50 and is located near the top end of the hinge pin 50. The tangential roller 60 rotates on the hinge pin 50. Vertical axis 52 serves as the axis of rotation for the tangential roller 60. The tangential roller 60 serves as a second guide roller assembly in conjunction with a first guide roller assembly comprised of wheels 70, 71 and 72 described below. Tangential roller 60 engages a lower complementary guide portion 62 in the curved portion 42 of top track 36 (see also FIG. 8A) whereby movement of the door assemblies 46 through the curved track portion 42 is facilitated.

As shown in FIG. 6, the top track 36 is comprised of a trackway that includes inner and outer parallel track portions 62 and 64, respectively, in the front and side track portions. As shown in FIGS. 6 and 8, the tracks include inner and outer concentric track portions 66 and 68, respectively (shown also in FIG. 8A) in the curved portion 42.

Figure 8A:
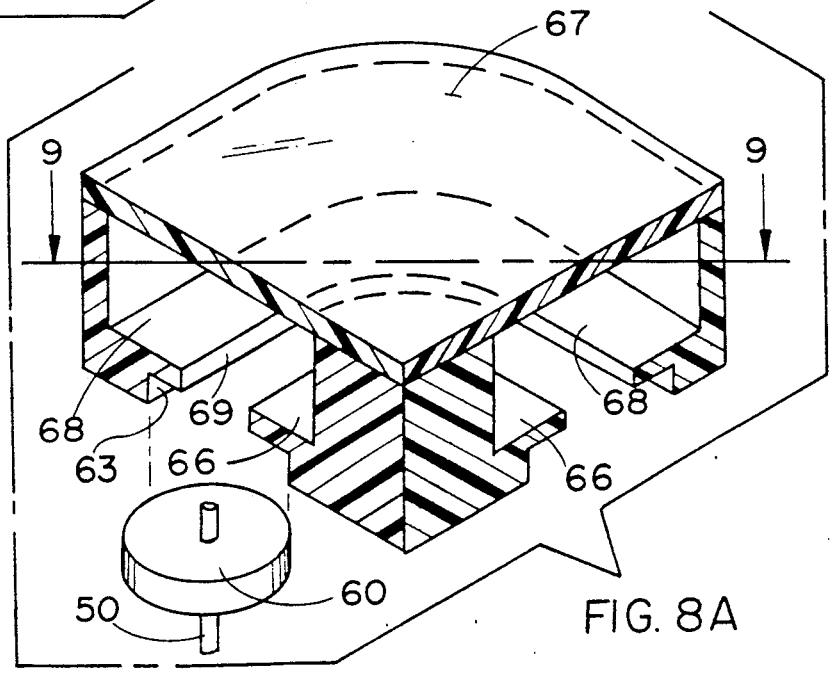
FIG. 8A is an enlarged view of the upper guide portion that turns the door panels 90 degrees.

As shown in FIGS. 8 and 8A, the curved portion 42 may be composed of a one-piece plastic fixture 42 which includes both the inner and outer concentric track portions 66 and 68. Top plate 67 keeps the track portions 66 and 68 in stable arrangement with respect to one another. A slot 69 for travel of the hinge pins 50 is also shown.

Figure 5:
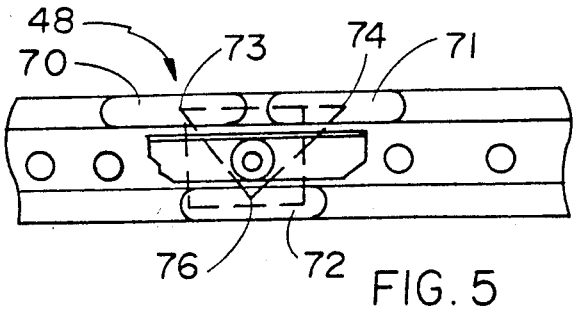
FIG. 5 is a top view of a three-wheeled carriage, shown in FIG. 4, which supports a hinge pin and associated assemblies.

As shown in FIG. 5, the carriage 48 includes three wheels journaled substantially or horizontal axes and arranged in a triangular pattern. Two wheels 70 and 71 are arranged in tandem and are located at two vertices 73 and 74 of the triangle 75. A single wheel 72 is located at the third vertex 76 of the triangle 75. The wheels 70, 71 and 72 comprise a first guide roller assembly. The two tandem carriage wheels 70 and 71 are positioned to ride in the outer tracks 64 and 68, and the single carriage wheel 72 is positioned in the inner tracks 62 and 66, whereby the carriage 48 is capable of readily move through the curved track portion 42 which has a tight radius for a right angle bend. The tracks 64, 68, 62 and 66 form upper guide tracks of a trackway. The hinge pin 50 and vertical axis 52 are located at the center of the triangle 75.

In accordance with another aspect of the invention for an elevator cab having an access opening and at least one side wall portion, a combination is provided which includes a retractable door assembly having a closed position covering the access opening and further having a retracted position substantially adjacent to the side wall of the elevator cab. The door assembly is segmented and includes a plurality of panels 24 pivoted with respect to each other by hinge pins 50. A trackway for supporting the door assembly includes upper and lower guide tracks, respectively. Upper guide track is comprised of tracks 64, 68, 62 and 66. Lower guide track is comprised of guide portion 63. Each guide track includes a curved portion substantially between the access opening and the side wall portion of the elevator cab. A carriage 48 is connected to each door panel 24 for supporting the weight thereof. Each carriage 48 includes at least one first guide roller (wheels 70, 71, 72) journaled substantially on a horizontal axis and riding in the upper guide track. Each carriage further includes a second guide roller (tangential roller 60) journaled substantially on a vertical axis (hinge pin 50) and riding in the lower guide track. The first guide roller has a lateral clearance with respect to at least the curved portion of the guide track, so that any lateral thrust loads are taken up by the second guide roller (tangential roller 60) as the segmented door is retracted into its open position and extended into its closed position with respect to the elevator cab, respectively. Thereby a free and easy movement is assured and jamming problems are eliminated as the segmented door is guided by the lower guide track. The tangential roller 60, in guiding the door panels 24, prevents the carriage wheels 70, 71 and 72 from rubbing up against the side walls adjacent the tracks 66 and 68. Thereby, wheels 70, 71 and 72 roll freely as the door panels 24 move through the respective right angle bends.

Generally, FIG. 8 shows how the center of the carriage 48, the hinge pin 50, the tangential rollers 60 and 90, and the bottom roller 88 turn simultaneously on the vertical axis 52.

Figure 9:
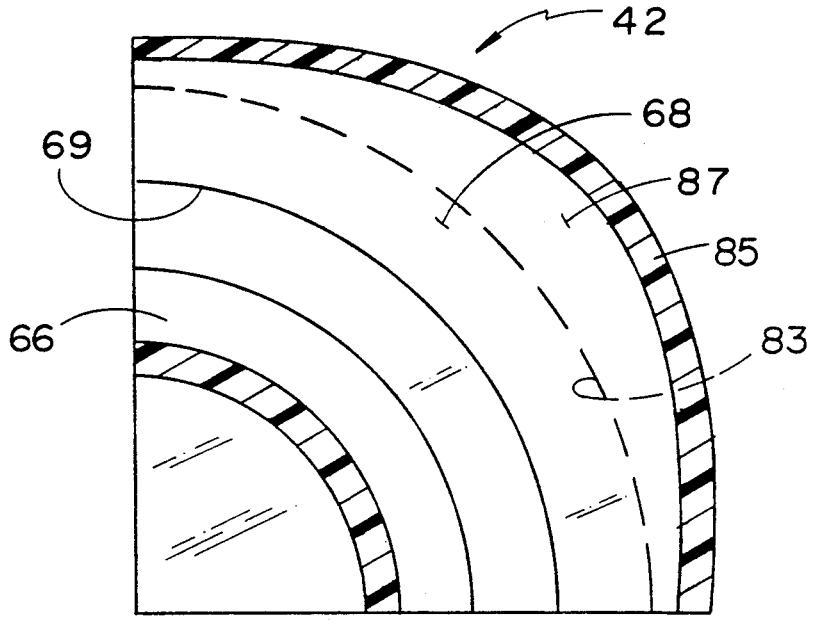
FIG. 9 is a cross-sectional view, taken along the line 9—9 in FIG. 8, of the upper guide portion.

Referring to FIG. 9, the relative shapes of a hinge pin slot 69, the inner track portion 66, and the outer concentric track portion 68 of the right angle track portion 42 are shown. It is noted that whereas the inner track portion 66 and the hinge pin slot 69 are substantially in the shape of concentric and circular bands, the outer track portion 68 takes the form of an enlarged, non-circular band. A circular band is shown as bordered by dashed line 83. The surface area 87 in the region between dashed line 83 and side wall 85 of the one-piece plastic fixture 42 is provided to accommodate the outer wheels 70 and 71 of the carriage 48 shown in FIG. 5. If the surface area 87 were not provided, the outer wheels 70 and 71 would bind up against a concentric outer wall of the fixture 42.

As shown in FIG. 4, nylon bushings 78 are provided to space upper and lower hollow tubes 80 and 81, respectively, from the hinge pin 50. The bushings 78 may be forced into the hollow tube 80 to be supported thereby. The hollow tubes 80 and 81, by being spaced from the hinge pin 50, serve to jacket the hinge pin 50 and serves to occupy most of the space between the hinge pin 50 and edges of adjacent panels 24. With the tubes 80 and 81 occupying the space between adjacent panels 24 and the hinge pin 50, the tubes 80 and 81 prevent limbs, such as fingers, hands, and arms, of elevator passengers from entering the space between the hinge pin 50 and adjacent panels 24. Right angle brackets 82 are attached to door panels 24 and retain the hollow tubes 80 and 81 jacketing the hinge pin 50.

As an alternate embodiment of a door assembly 46, a sheet may be attached to the door panel 24 and may extend around the hinge pin 50 in order to occupy space between the hinge pin 50 and an edge of an adjacent panel 24, whereby the sheet prevents limbs of elevator passengers from entering the space between the hinge pin 50 and an adjacent panel 24.

As shown in FIG. 4, in addition to top track 36, a bottom track 86 is also present. Both the top track 36 and the bottom track 86 are supported by the cab 10, and both tracks have front portions, curved portions, and side portions. The straight hinge pin 50, supported by the carriage 48, extends down to the bottom track 86. Movement of the hinge pin 50 is guided by both the top and bottom tracks.

Figure 11:
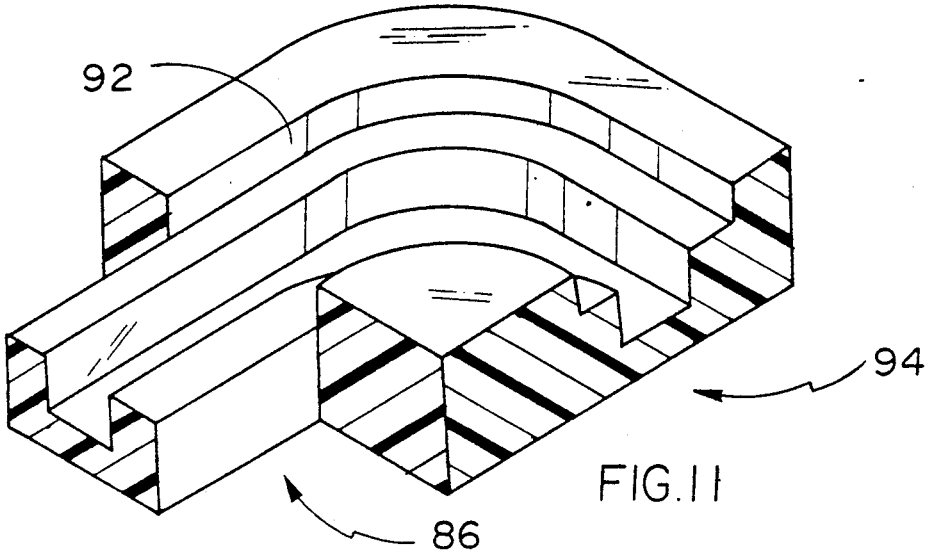
FIG. 11 is an enlarged view of the lower guide portion that turns the door panels 90 degrees.

As shown in FIGS. 4 and 6, a bottom roller 88 is connected to the bottom end of the hinge pin 50. The bottom roller 88 rides in the bottom horizontal track 86. Near the bottom end of the hinge pin 50, a second tangential roller 90 is located. Tangential roller 90 rides in a complementary bottom roller guide portion 92 (see FIG. 11) of the bottom circular portion 94 of the bottom track 86.

Figure 10:
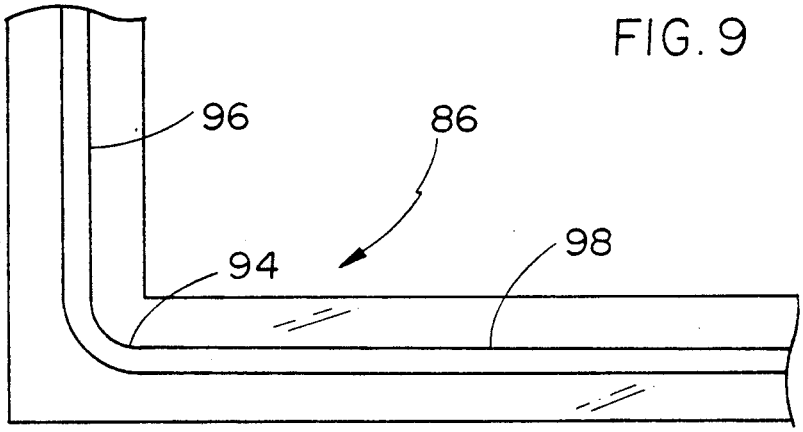
FIG. 10 is a top view of the lower guide portion for the embodiment of the retractable door of the invention shown in FIG. 2.

Referring to FIG. 10, a top view of the bottom track 86 is shown. Bottom track 86 includes front portion 96, circular portion 94, and side portion 98. Front and side portions 96 and 98, respectively, may be fabricated from wood or plastic. Preferably, circular portion 94 is fabricated from plastic.

Figure 12:
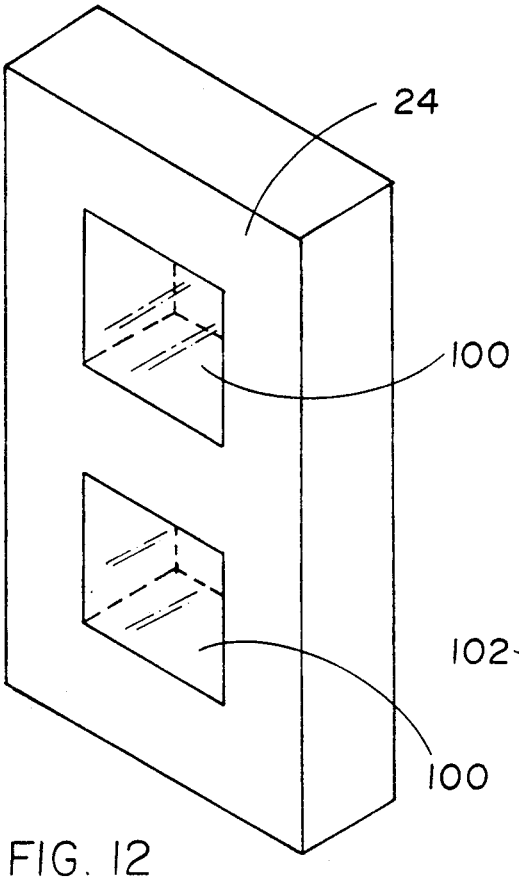
FIG. 12 is an enlarged schematic view of an individual door panel having transparent portions.

FIG. 12 shows a door panel 24 that includes transparent plastic windows 100. The windows 100 permit a passenger to see out the cab 10 and permit a person outside the elevator to see inside the cab 10.

Figure 13:
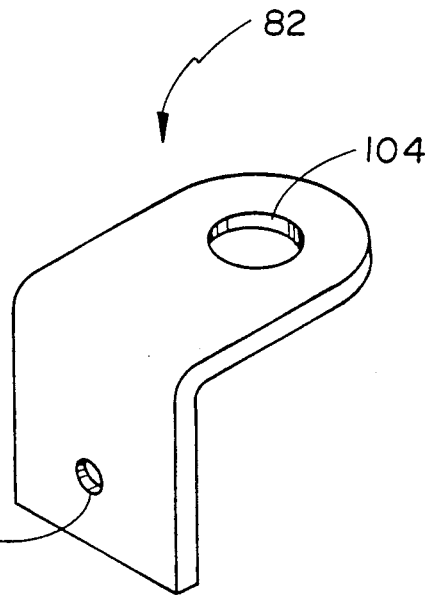
FIG. 13 is a right angle bracket for connecting adjacent sides of adjacent door panels.

FIG. 13 shows a right angle bracket 82 that is used to pivotally connect a door panel 24 with a hinge pin 50 at a point mid-way down the hinge pin 50. More specifically, a fastener, such as a screw (not shown) can be inserted through small side hole 102 to secure the right angle bracket 82 to the side of a door panel. When the right angle bracket 82 is installed on the side of a door panel, the hinge pin hole 104 is horizontally oriented to receive a hinge pin 50 to pivotally connect the door panel 24 to the hinge pin 50. As shown in FIG. 4, right angle brackets for adjacent door panels are installed on the adjacent door panels so that the hinge pin holes 104 of adjacent angle brackets 82 overlap one another, permitting a hinge pin 50 to pivotally connect both door panels to the same hinge pin.

Figure 14:
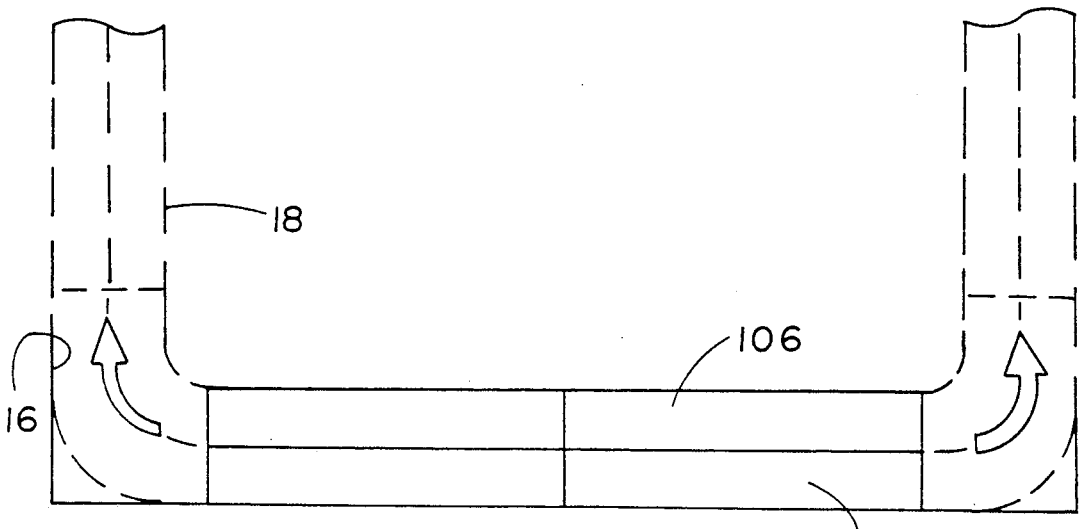
FIG. 14 is a top schematic view of another embodiment of the retractable door of the invention in which double retractable doors are provided, one for the elevator cab (the inner door) and for hoistway (the outer door).

FIG. 14 shows another embodiment of the retractable elevator door of the invention. In this invention, two retractable doors of the invention are employed. The inner door 106 is the cab door. The outer door 108 is the hoistway door. When the elevator cab is positioned appropriately on a floor, a clutch (not shown) on the cab door 106 engages a roller (not shown) on the hoistway door 108. By operating the cab door 106 manually, the hoistway door 108 is engaged and is operated simultaneously with the cab door 106. In FIG. 14, the cab door 106 is retracted to an open position, whereby the door panels are located outside the cab wall 18 in the space between the outside of the cab walls 18 and the hoistway wall 16.

Obviously, many modifications may be made without departing from the basic spirit of the present invention. For example, the upper and lower side track portions can be located either inside the cab or outside the cab between the cab wall and the hoistway wall. Accordingly, it will be appreciated by those skilled in the art that within the scope of the appended claims, the invention may be practiced other than has been specifically described herein.

What is claimed is:

1. A door apparatus for an elevator cab opening, wherein the elevator cab has a top track including a right angle bend and a plurality of concentric track portions, said apparatus comprising:

a plurality of door assemblies, each of a plurality of said door assemblies including:

a carriage including a plurality of wheels, at least one of said wheels being supported by each of the concentric track portions of the top track and guided thereby, a hinge pin supported by said carriage at a location between the concentric track portions and extending down toward the bottom of the elevator cab, movement of said hinge pin being guided by the top track, means, connected to a door panel, for supporting a door panel, said panel supporting means being in pivotal connection with said hinge pin, a door panel connected to said panel support means and supported thereby, wherein said carriage, said hinge pin, said panel support means, and said door panel turn on the same vertical axis defined by the longitudinal axis of said hinge pin when a door assembly is moved through said right angle bend of the top track.

2. The apparatus described in claim 1 wherein said door panel includes a transparent portion.

3. The apparatus described in claim 1 wherein said hinge pin includes a top end and a bottom end and wherein said panel support means includes a bottom-most panel support located at the bottom end of the said panel near the bottom end of said hinge pin, further including:

means, located near the bottom end of said hinge pin and supported thereby, for supporting the weight of adjacent door panels by supporting said bottom-most panel support.

4. The apparatus described in claim 3 wherein said door panel weight support means includes a locknut supported by said hinge pin and located near the bottom end thereof.

5. The apparatus described in claim 1 wherein said means for supporting the door panel includes end portions and a mid-portion, each of said hinge pin and said means for supporting the door panel.

6. The apparatus described in claim 1, further including:

sheet means, attached to said door panel and extending around said hinge pin, for occupying space between said hinge pin and an edge of an adjacent panel, whereby said sheet means prevents limbs of elevator passengers from entering said space between said hinge pin and said adjacent panel.

7. The apparatus described in claim 1 wherein said plurality of door assemblies are supported by and guided by the top track.

8. A door apparatus for an elevator cab opening, wherein the elevator cab has a top track including a right angle bend, said apparatus comprising:

a plurality of door assemblies supported by and guided by the top track, each of a plurality of said door assemblies including:

a carriage supported by the top track and guided thereby a straight hinge pin supported by said carriage and extending down toward the bottom of the elevator cab, movement of said hinge pin being guided by the top track, means, connected to a door panel, for supporting a door panel, said panel supporting means being in pivotal connection with said hinge pin, a door panel connected to said panel support means and supported thereby, wherein said carriage, said hinge pin, said panel support means, and said door panel turn on the same vertical axis defined by the longitudinal axis of said hinge pin when a door assembly is moved through said right angle bend of the top track, wherein said hinge pin includes a top end and a bottom end, said apparatus further including:

a tangential roller supported by said hinge pin and located near the top end of said hinge pin, said tangential roller capable of rotating around said hinge pin which serves as axis of rotation, wherein said tangential roller engages a complementary guide portion in said top track, whereby movement of said door assemblies through said curved track portion is facilitated.

9. A door apparatus for an elevator cab opening, wherein the elevator cab has a top track including a right angle bend, said apparatus comprising:

a plurality of door assemblies supported by and guided by the top track, each of a plurality of said door assemblies including:

a carriage supported by the top track and guided thereby a straight hinge pin supported by said carriage and extending down toward the bottom of the elevator cab, movement of said hinge pin being guided by the top track, means, connected to a door panel, for supporting a door panel, said panel supporting means being in pivotal connection with said hinge pin, a door panel connected to said panel support means and supported thereby, means for spacing a hollow tube from said hinge pin, a hollow tube spaced from said hinge pin, said tube jacketing said hinge pin and occupying space between said hinge pin and edges of adjacent panels, whereby said tube prevents limbs of elevator passengers from entering said space between said hinge pin and adjacent panels, and means, attached to said door panel, for supporting said hollow tube, wherein said hollow tube support means includes a bushing force fit onto said hollow tube, wherein said carriage, said hinge pin, said panel support means, and said door panel turn on the same vertical axis defined by the longitudinal axis of said hinge pin when a door assembly is moved through said right angle bend of the top track.

10. A door apparatus for an elevator cab opening, said apparatus comprising:

a top track supported by the cab and including a front portion substantially parallel to the cab opening and adjacent thereto, a curved portion contiguous with said front portion and undergoing a substantially right angle bend, and a side portion contiguous to said right angle bend and substantially parallel to a side wall of the cab and adjacent thereto wherein said top track comprises a plurality of concentric track portions, a plurality of door assemblies supported by and guided by said top track, said door assemblies capable of being moved along said track and serving to close the cab opening when they are located parallel to the cab opening and serving to open the cab opening when they are located away from the cab opening, each of a plurality of said door assemblies including:

a carriage supported by said top track and guided thereby, a straight hinge pin supported by said carriage and extending down toward the bottom of the elevator cab, movement of said hinge pin being guided by said top track, means, connected to a door panel, for supporting a door panel, said panel supporting means being in pivotal connection with said hinge pin, a door panel connected to said panel support means and supported thereby, wherein said carriage, said hinge pin, said panel support means, and said door panel turn on the same vertical axis defined by the longitudinal axis of said hinge pin when a door assembly is moved through said right angle bend of said top track.

11. A door apparatus for an elevator cab opening, said apparatus comprising:

a top track supported by the cab and including a front portion substantially parallel to the cab opening and adjacent thereto, a curved portion contiguous with said front portion and undergoing a substantially right angle bend, and a side portion contiguous to said right angle bend and substantially parallel to a side wall of the cab and adjacent thereto, a plurality of door assemblies supported by and guided by said top track, said door assemblies capable of being moved along said track and serving to close the cab opening when they are located parallel to the cab opening and serving to open the cab opening when they are located away from the cab opening, each of a plurality of said door assemblies including:

a carriage supported by said top track and guided thereby, a hinge pin supported by said carriage and extending down toward the bottom of the elevator cab, movement of said hinge pin being guided by said top track, means, connected to a door panel, for supporting a door panel, said panel supporting means being in pivotal connection with said hinge pin, a door panel connected to said panel support means and supported thereby, wherein said carriage, said hinge pin, said panel support means, and said door panel turn on the same vertical axis defined by the longitudinal axis of said hinge pin when a door assembly is moved through said right angle bend of said top track, wherein said top track includes inner and outer parallel track portions in said front and side track portions and includes inner and outer concentric track portions in said curved portion.

12. The apparatus described in claim 11 wherein said hinge pin is a straight hinge pin.

13. A door apparatus for an elevator cab opening, said apparatus comprising:

a top track supported by the cab and including a front portion substantially parallel to the cab opening and adjacent thereto, a curved portion contiguous with said front portion and undergoing a substantially right angle bend, and a side portion contiguous to said right angle bend and substantially parallel to a side wall of the cab and adjacent thereto.

a plurality of door assemblies supported by and guided by said top track, said door assemblies capable of being moved along said track and serving to close the cab opening when they are located parallel to the cab opening and serving to open the cab opening when they are located away from the cab opening, each of a plurality of said door assemblies including:

a carriage supported by said top track and guided thereby, a hinge pin supported by said carriage and extending down toward the bottom of the elevator cab, movement of said hinge pin being guided by said top track, means, connected to a door panel, for supporting a door panel, said panel supporting means being in pivotal connection with said hinge pin, a door panel connected to said panel support means and supported thereby, wherein said carriage, said hinge pin, said panel support means, and said door panel turn on the same vertical axis defined by the longitudinal axis of said hinge pin when a door assembly is moved through said right angle bend of said top track, wherein said carriage includes three wheels arranged in a triangular pattern, two wheels arranged in tandem and located at two vertices of the triangle, a single wheel located at the third vertex of the triangle, said two tandem carriage wheels positioned in said outer track, said single carriage wheel positioned in said inner track, whereby said carriage is capable of readily moving through said curved track portion.

14. The apparatus described in claim 13 wherein said hinge pin is a straight hinge pin.

15. A door apparatus for an elevator cab opening, said apparatus comprising:

a top track supported by the cab and including a front portion substantially parallel to the cab opening and adjacent thereto, a curved portion contiguous with said front portion and undergoing a substantially right angle bend, and a side portion contiguous to said right angle bend and substantially parallel to a side wall of the cab and adjacent thereto, a plurality of door assemblies supported by and guided by said top track, said door assemblies capable of being moved along said track and serving to close the cab opening when they are located parallel to the cab opening and serving to open the cab opening when they are located away from the cab opening, each of a plurality of said door assemblies including:

a carriage supported by said top track and guided thereby, a straight hinge pin supported by said carriage and extending down toward the bottom of the elevator cab, movement of said hinge pin being guided by said top track, means, connected to a door panel, for supporting a door panel, said panel supporting means being in pivotal connection with said hinge pin, a door panel connected to said panel support means and supported thereby, wherein said carriage, said hinge pin, said panel support means, and said door panel turn on the same vertical axis defined by the longitudinal axis of said hinge pin when a door assembly is moved through said right angle bend of said top track, wherein said elevator cab includes a wall and wherein:

said plurality of door assemblies are located parallel to a side wall of said cab when the door is in the open position, said door panels are bounded by boundary lines parallel to said front rack portion when the door is closed and parallel to and said side track portion when the door is open and, said door panels move from a closed to an open position and vice versa without crossing said boundary lines.

16. A door apparatus for an elevator cab opening, said apparatus comprising:

a top track and a bottom track, each of said tracks being supported by the cab and including a front portion substantially parallel to the cab opening and adjacent thereto, a curved portion contiguous with said front portion and undergoing a substantially right angle bend, and a side portion contiguous to said right angle bend and substantially parallel to a side wall of the cab and adjacent thereto, said top track including a plurality of concentric track portions, a plurality of door assemblies supported by and guided by said top track and guided by said bottom track, said door assemblies capable of being moved along said tracks and serving to close the cab opening when they are located parallel to the cab opening and serving to open the cab opening when they are located parallel to the side wall of the cab, a door assembly of said plurality including, a carriage supported by said top track and guided thereby, said carriage including a plurality of wheels, at least one of said wheels being supported by each of the concentric track portions of the top track and guided thereby, a hinge pin supported by said carriage at a location between the concentric track portions, and extending down to said bottom track, movement of said hinge pin being guided by said top and bottom tracks, means, connected to a door panel, for supporting the door panel, said panel supporting means being in pivotal connection with said hinge pin, a panel connected to said panel support means and supported thereby, wherein said carriage, said hinge pin, said panel support means, and said panel turn on the same vertical axis defined by the longitudinal axis of said hinge pin when said door assembly is moved through said right angle bends of said tracks.

17. A door apparatus for an elevator cab opening, comprising:

a top track and a bottom track, each of said tracks including a front portion substantially parallel to the cab opening, a curved portion adjacent said front portion and undergoing a substantially right angle bend, and a side portion adjacent said right angle bend, substantially parallel to a side wall of the cab, wherein said top track includes inner and outer parallel track portions in said front and side portions and includes inner and outer concentric portions in said curved portion, a plurality of door assemblies supported by and guided by said top track and guided by said bottom track, a door assembly of said plurality including, a carriage riding in said top track, wherein said carriage includes three wheels arranged in a triangular pattern, two wheels arranged in tandem and located at two vertices of the triangle, a single wheel located at the third vertex of the triangle, said two tandem carriage wheels positioned in said outer track, said single carriage wheel positioned in said inner track, whereby said carriage is capable of readily moving through said curved track portion, a hinge pin supported by said carriage and extending down to said bottom track and guided thereby, a tangential roller supported by said hinge pin and located near the top end of said hinge pin, said tangential roller capable of rotating around said hinge pin which serves as axis of rotation, wherein said tangential roller engages a complementary guide portion in said top track, whereby movement of said door assemblies through said curved track portion is facilitated, as said tangential roller moves through said complementary guide portion, means for supporting a door panel in pivotal connection with said hinge pin, a panel connected to said panel support means and supported thereby, wherein said carriage, said hinge pin, said tangential roller, said panel support means, and said panel turn on the same vertical axis defined by the longitudinal axis of the hinge pin when said door assembly is moved through said right angle bends of said tracks.

18. A door panel apparatus, comprising;

a carriage capable of riding in an overhead horizontal track having a plurality of concentric track portions and having an angular bend, said carriage including a plurality of wheels, at least one of said wheel supported by each of the concentric track portions, a hinge pin including a top end, a mid-portion, and a bottom end, supported at the top end by the said carriage at a location between said concentric track portions and extending vertically down from said carriage for a predetermined length, a door panel having a shorter vertical length than the vertical length of said hinge pin, means for supporting said door panel in pivotal connection with said hinge pin, wherein said carriage, said hinge pin, and said panel support means turn on the same vertical axis defined by the longitudinal axis of said hinge pin when said door panel is moved through said angular bend of said track.

19. The apparatus described in claim 16, further including: a bottom roller connected to the bottom end of said hinge pin, said bottom roller capable of riding in a bottom horizontal track having an angular bend.

20. The apparatus described in claim 16 wherein said angular bend is a right angle bend..

21. A door panel assembly apparatus, comprising:

a carriage capable of riding in an overhead horizontal track having a plurality of concentric track portions and having an angular bend, said carriage including a plurality of wheels, at least one of said wheel supported by each of the concentric track portions, a hinge pin including a top end, a mid-portion, and a bottom end, supported at the top end by the said carriage at a location between said concentric track portions and extending vertically down from said carriage for a predetermined length, a door panel having a shorter vertical length than the vertical length of said hinge pin, means for supporting said door panel in pivotal connection with said hinge pin, a bottom guide connected to the bottom end of said hinge pin, said bottom guide capable of riding in a bottom horizontal track having a right angle bend, wherein said carriage, said hinge pin, and said panel support means turn on the same vertical axis defined by the longitudinal axis of said hinge pin when said door panel is moved through said right angle bends of said tracks.

22. The apparatus described in claim 21, further including:

means for spacing a hollow tube from said hinge pin, a hollow tube spaced from said hinge pin by said spacing means, said tube jacketing said hinge pin and occupying space between said hinge pin and an edge of said door panel, whereby said tube prevents limbs of elevator passengers from entering said space between said hinge pin and said door panel, means, attached to said door panel, for supporting said hollow tube jacketing said hinge pin.

23. The apparatus described in claim 21, further including:

sheet means, attached to said door panel and extending around said hinge pin, for occupying space between said hinge pin and an edge of said door panel, whereby said sheet means prevents limbs of elevator passengers from entering said space between said hinge pin and said door panel.

24. The door panel assembly described in claim 21 wherein said bottom guide is a roller.

25. A door panel assembly apparatus, comprising:

a carriage capable of riding in an overhead horizontal track having a right angle bend, a hinge pin including a top end, a mid-portion, and a bottom end, supported at the top end by said carriage and extending vertically down from said carriage for a predetermined length, a door panel having a shorter vertical length than the vertical length of said hinge pin, means for supporting said door panel in pivotal connection with said mid-portion of said hinge pin, a bottom roller connected to the bottom end of said hinge pin, said bottom roller capable of riding in a bottom horizontal track having a right angle bend, a tangential roller supported by said hinge pin and located near the top end of said hinge pin, said tangential roller capable of rotating around said hinge pin serving as axis of rotation, wherein said tangential roller engages a complementary guide portion in said top track, whereby movement of said door panel assembly through said right angle bend is facilitated, wherein said carriage, said hinge pin, and said panel support means turn on the same vertical axis defined by the longitudinal axis of said hinge pin when said door panel is moved through said right angle bends of said tracks.

26. A door panel assembly described in claim 25 wherein said tangential guide is a roller.

27. Apparatus for supporting a door panel, comprising:

a carriage capable of riding in an overhead horizontal track, having a plurality of concentric track portions, and said carriage including a plurality of wheels, at least one of said wheel supported by each of the concentric track portions, a hinge pin including a top end, a mid-portion, and a bottom end, supported at the top end by the said carriage at a location between said concentric track portions and extending vertically down from said carriage for a predetermined length, horizontal panel support bars capable of supporting the door panel, said support bars in pivotal connection with said hinge pin, a bottom guide connected to the bottom end of said hinge pin, said bottom guide capable of riding in and being guided by a bottom horizontal track.

28. The apparatus described in claim 27 wherein said horizontal support bars include end portions and a mid-portion, each of said end portions including an orifice through which a hinge pin is passed to provide pivotal connection between the hinge pin and the horizontal support bars.

29. In an elevator cab having an access opening and further having at least one side wall portion, the combination of a retractable door assembly having a closed position covering the access opening and further having a retracted position substantially adjacent to the side wall of the elevator cab, the door assembly being segmented and including a plurality of panels pivoted with respect to each other, means located above said panels, including a trackway for supporting the door assembly and including upper and lower guide tracks, respectively, each guide track including a curved portion substantially between the access opening and the side wall portion of the elevator cab, said upper guide track including two concentric track portions, a carriage connected to each door panel for supporting the weight thereof, each carriage including at least two first guide rollers journaled substantially on horizontal axes and riding in the upper guide track, at least one of said first guide rollers riding in each of said concentric track portions, each carriage connected with a vertically extending hinge pin having a longitudinal axis, said hinge pin extending vertically between said concentric track portions, said hinge pin including a second guide roller journaled substantially on said vertically extending hinge pin, straddling the longitudinal axis thereof, and riding in the lower guide track, the first guide rollers having a lateral clearance with respect to at least the curved portion of the guide track, so that the lateral thrust loads are taken up by the second guide roller as the segmented door is retracted onto its open position and extended into its closed position with respect to the elevator cab, respectively, thereby assuring a free and easy movement and eliminating jamming problems, and means for guiding the segmented door on the lower guide track.

30. In an elevator cab having an access opening and further having at least one side wall portion, the combination of a retractable door assembly having a closed position covering the access opening and further having a retracted position substantially adjacent to the side wall of the elevator cab, the door assembly being segmented and including a plurality of panels pivoted with respect to each other, means located above said panels, including a trackway for supporting the door assembly and including upper and lower guide tracks, respectively, each guide track including a curved portion substantially between the access opening and the side wall portion of the elevator cab, a carriage connected to each door panel for supporting the weight thereof, each carriage including at least one first guide roller journaled substantially on a horizontal axis and riding in the upper guide track, each carriage connected with a vertically extending hinge pin, said hinge pin including a second guide roller journaled substantially on said vertically extending hinge pin and riding in the lower guide track, the first guide roller having a lateral clearance with respect to at least the curved portion of the guide track, so that the lateral thrust loads are taken up by the second guide roller as the segmented door is retracted onto its open position and extended into its closed position with respect to the elevator cab, respectively, thereby assuring a free and easy movement and eliminating jamming problems, and means for guiding the segmented door on the lower guide track, further including two additional first guide rollers, said three guide rollers forming a three-wheeled assembly.

31. A door apparatus for an elevator cab opening, wherein the elevator cab has a top track and a bottom track, each track including a right angle bend, said apparatus comprising:

a plurality of door assemblies supported by the top track and guided by the top and bottom tracks, each of a plurality of said door assemblies including:

a carriage supported by the top track and guided thereby, a straight hinge pin supported by said carriage and extending down toward the bottom of the elevator cab, movement of said hinge pin being guided by the top and bottom tracks, wherein said hinge pin includes a top end and a bottom end, a first tangential roller supported by said hinge pin and located near the top end of said hinge pin, said first tangential roller capable of rotating around said hinge pin which serves as axis of rotation, wherein said first tangential roller engages a complementary guide portion in the top track, whereby movement of said door assemblies through said curved track portion is facilitated, a second tangential roller supported by said hinge pin and located near the bottom end of said hinge pin, said second tangential roller capable of rotating around said hinge pin which serves as axis of rotation, wherein said second tangential roller engages a complementary guide portion in the bottom track, whereby movement of said door assemblies through said curved track portion is facilitated,.

a plurality of door panels separated by gaps therebetween, for the plurality of door panels, means, connected to a respective door panel, for supporting the respective door panel, said panel supporting means being in pivotal connection with said hinge pin, and means, connected to adjacent door panels, for closing the gap between the adjacent panels, wherein said carriage, said hinge pin, said panel support means, and said door panel turn on the same vertical axis defined by the longitudinal axis of said hinge pin when a door assembly is moved through said right angle bend of the top and bottom tracks.

32. In a retractable door apparatus for an elevator cab, wherein the door apparatus goes around a right-angle bend in the cab, the combination of a top track including an inner top track and further including an outer top track disposed substantially concentrically with respect to the inner top track, a carriage supported on the top track and including first roller means guided in the inner top track and further including second roller means guided in the outer top track, a hinge pin carried by the carriage and extending therebelow on a substantially vertical axis intermediately of the inner and outer top tracks, at least one pair of door assemblies mounted to the hinge pin, and means carried by the hinge pin for closing the gap between the pair of door assemblies, especially as the door assemblies go around the right-angle bend in the elevator cab.

33. In a retractable door apparatus for an elevator cab, wherein the door apparatus goes around a right-angle bend in the cab, the combination of a top track including an inner top track and further including an outer top track disposed substantially concentrically with respect to the inner top track, a carriage supported on the top track and including first roller means guided in the inner top track and further including second roller means guided in the outer top track, the second roller means including a pair of rollers disposed on substantially horizontal axes, respectively, the first roller means including a roller disposed on a substantially horizontal axis which is intermediately of the substantially horizontal axes of the pair of rollers in the second roller means, thereby providing a "three-point" suspension for the carriage, a hinge pin carried by the carriage and extending therebelow on a substantially vertical axis intermediately of the inner and outer top tracks, and at least one pair of door assemblies mounted to the hinge pin.

34. In a retractable door apparatus for an elevator cab, wherein the door apparatus goes around a right-angle bend in the cab, the combination of a top track including an inner top track and further including an outer top track disposed substantially concentrically with respect to the inner top track, a carriage supported on the top track and including first roller means guided in the inner top track and further including second roller means guided in the outer top track, the first and second roller means being disposed on respective horizontal axes, the top track further including a lower track portion disposed below the inner and outer tracks, a hinge pin carried by the carriage and extending therebelow on a substantially vertical axis intermediately of the inner and outer top tracks, at least one pair of door assemblies mounted to the hinge pin, and a third roller means carried by the hinge pin, guided in the lower track portion of the top track, and providing tangential support for the door assemblies as the carriage goes around the right-angle bend.

35. The combination of claim 34, including a bottom track, and further including a fourth roller means carried by the hinge pin, the fourth roller means being disposed on a vertical axis and riding in the bottom track, thereby providing further tangential support for the door assemblies as the carriage goes around the right-angle bend.

* * * * *